US005484635A

United States Patent [19]

Andersen et al.

[11] Patent Number: 5,484,635

[45] Date of Patent: Jan. 16, 1996

[54] MULTIPURPOSE DRIP CATCHER

[76] Inventors: Carl E. Andersen, Løvfaldsvej 20 B, Skærbæk, DK-8600 Silkeborg; Ole Kramer, Tornevangsvej 34 F, DK-3460 Birkerød, both of Denmark

[21] Appl. No.: 186,916

[22] Filed: Jan. 27, 1994

[51] Int. Cl.[6] ..... B67D 1/16

[52] U.S. Cl. ..... 428/40; 222/108; 222/111; 428/68; 428/76; 428/137; 428/138; 428/192; 428/194; 428/212; 428/220; 428/913

[58] Field of Search ..... 428/40, 192, 194, 428/131, 76, 68, 212, 220, 137, 138, 913; 604/361, 385.1; 222/108, 111

[56] References Cited

U.S. PATENT DOCUMENTS 3,952,746 4/1976 Summers ..... 604/361
4,182,334 1/1980 Johnson ..... 604/385.2
4,341,217 7/1982 Ferguson ..... 604/385.1
4,535,020 8/1985 Thomas ..... 604/385.1
4,634,440 1/1987 Widlund ..... 604/385.1

*Primary Examiner*—Nasser Ahmad
*Attorney, Agent, or Firm*—Watson, Cole, Grindle & Watson

[57] ABSTRACT

Sanitary household or laboratory article in the form of a multi-purpose drip catcher of the apply-and-discard type, formed as a small, essentially flat pocket (1) made from water-proof non-transparent foil material (2), which pocket is open in its upward direction and the walls of which are glued or welded together along the pocket borders (3,4). The back wall of the pocket (1) is provided with an adhesive (5) for application of the pocket onto a container wall. The inside of the pocket (1) is essentially filled with a strongly absorbing hydrophilic material (6), and the pocket (1) may additionally be provided with saturation indicator (7,8) for disclosing the saturation of the material (6) with liquid.

6 Claims, 3 Drawing Sheets

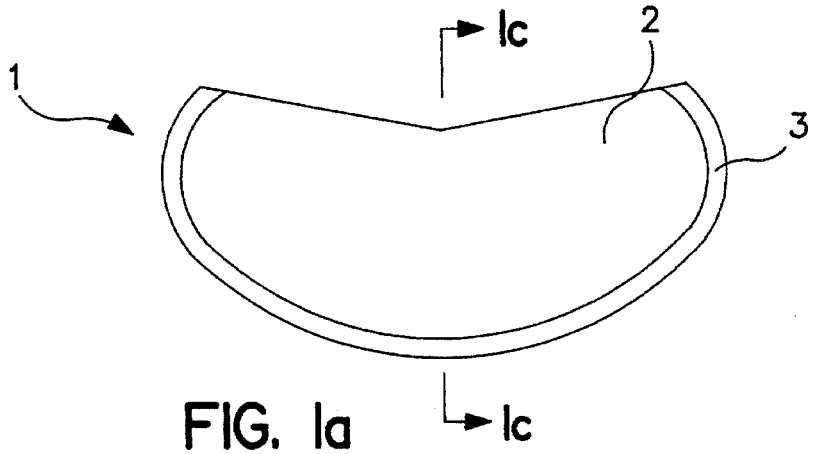
FIG. Ia
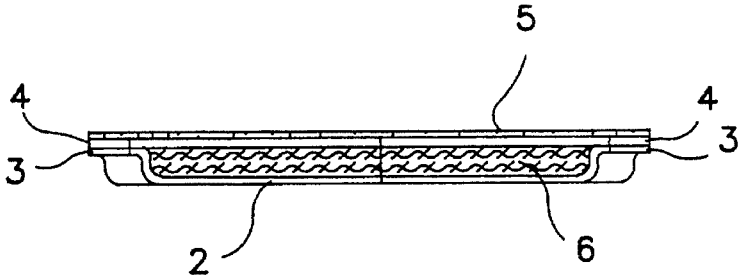
FIG. Ib
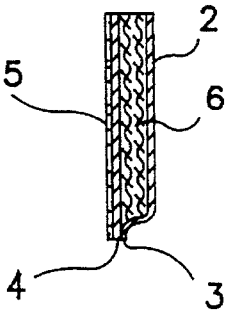
FIG. Ic
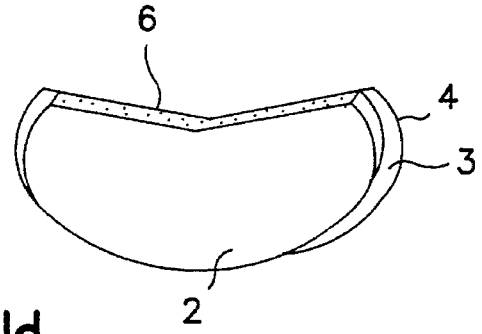
FIG. Id

MULTIPURPOSE DRIP CATCHER

BACKGROUND OF THE INVENTION

1. Field of the Invention

The invention concerns a sanitary household or laboratory article in the form of a drip catcher of the apply-and-discard type. Previously, drip catchers have been known for example in the shape of a small pad or roll of hydrophilic material which, by the use of rubber bands or strings, is positioned under the spout of a tea or coffee pot. Such drip catchers are frequently used for too long before their replacement or washing so that not only may they assume an unaesthetic brown discoloration, but frequently they also become over-saturated with liquid and consequently drip, since the precise point of their saturation cannot be determined in due time.

2. The Prior Art

Other types of drip catchers, especially for one-time application, are for example disclosed in DK-C-41030, which describes the drip catcher as a piece of blotting paper that has been slit in the middle so that it can be pushed onto the spout of coffee pots, tea pots and the like; in DE-C-437, 230 which discloses a drip catcher consisting of one or more layers of absorbing material that can be glued onto, e.g., a pitcher by a water soluble glue, which means that the drip catcher automatically is removed when the pitcher is washed in water; in DE-C-896,014 which discloses a drip catcher, consisting of an absorbent material with a thin outer layer of plastic foil and manufactured according to the sticking plaster principle; and in U.S. Pat. No. 3,063,590 which also describes a drip catcher consisting of an absorbing material with a thin outer layer of plastic foil, and which is folded to a conically-shaped ring before the drip catcher is placed loosely on the neck of a bottle.

These last-mentioned types of drip catchers suffer from the same shortcomings as the first-mentioned ones: They quickly turn unaesthetic because their absorbing material becomes visibly discolored long before the material is saturated; their saturation point cannot be clearly defined, and even a light blow to the container might cause the drip catcher to loose drops because the absorbing material is open in the downward direction as well. Such lost drops represent a serious hygienic problem, not least in large-scale kitchens, canteens, restaurants, laboratories and similar places. Loss of drops from the drip catcher itself is also a problem when using a different type of drip catcher consisting of a thin foil shaped as a flat liquid-tight pocket and opening up and being expandable according to the bellows principle known for example from U.S. Pat. No. 4,415,100, especially FIGS. 1–4 in this publication. When using this type of drip catcher, drops are lost through the opening of the catcher when the container is inclined with the container opening pointing downwards, i.e., when a person tries to empty the container completely for liquid. Further, this type of drip catcher has the drawback that it will not be able to open up if applied on containers with convex or cylindrical surfaces.

It is therefore the object of the present invention to provide a multipurpose drip catcher of the apply-and-discard type which remedies the above-mentioned drawbacks of prior art drip catchers and the use of which is not limited to special types of containers.

SUMMARY OF THE INVENTION

The object is obtained through a drip catcher which is in the form of an essentially flat, partially elliptically-shaped, upwardly open pocket provided by front and back water-proof and non-transparent walls that are welded along their peripheries to define a liquid-tight chamber, which is essentially filled with hydrophilic material having a great capacity for the absorption of water-based liquids.

Particularly advantageous embodiments of the drip catcher according to the invention are mentioned in claims 2–8.

An especially important feature of the multipurpose drip catcher is therefore that the catcher is made as a practically water-proof pocket filled with a strongly absorbing hydrophilic material. Hereby is obtained partly that the drip catcher gets a large liquid-capacity, and partly that an unintended loss of drops from the drip catcher is prevented, no matter whether the container in a vertical position is exposed to a blow or is inclined so much that its opening points downwards. The reason why no drops are lost in the latter case is that the liquid caught is practically fully absorbed by the hydrophilic material. This results in considerable sanitary advantages, and the drip catcher according to the invention is therefore also very suitable for use in laboratories where it is important to avoid dripping from containers with aggressive or otherwise harmful liquids.

Before joining the front and back walls of the drip catcher, e.g., through adhesion, the front wall is shaped in such a manner that the drip catcher will remain open no matter whether it is applied on a planar surface, on a convex surface such as that of a tea pot, or on a cylindrical surface, e.g., of a bottle. A very small radius of curvature of a container surface will require considerably more material in the front wall than in the back wall of the drip catcher so as to allow the catcher to bend sufficiently without putting too much stress on adhesive joints and to prevent compression of the absorbing material or of the entrance opening of the drip catcher. The front wall may therefore be shaped through vacuum forming, allowing the front wall to be provided with a number of accordion-like folds, thus giving the drip catcher an additional bending ability.

In order to ensure replacement of the drip catcher in due time, which means replacement before its saturation point has been reached, the drip catcher may be provided with a saturation indicator, which in a simple manner indicates to the user when replacement of the catcher is imminent.

Finally, the drip catcher offers an advantage known per se in being suitable for mass production.

The invention will be explained in more detail in the following with reference to the attached drawings which schematically and without being limiting show embodiments of the drip catcher.

BRIEF DESCRIPTION OF THE DRAWINGS

FIG. 1*a* shows a front view of a drip catcher according to a first embodiment of the invention, FIG. 1*b* shows the same drip catcher seen from above, FIG. 1*c* shows a section through the drip catcher along the line 1*c*—1*c* in FIG. 1*a*, FIG. 1*d* is a perspective view of the same drip catcher.

DETAILED DESCRIPTION OF THE PREFERRED EMBODIMENTS

Figure 2A:
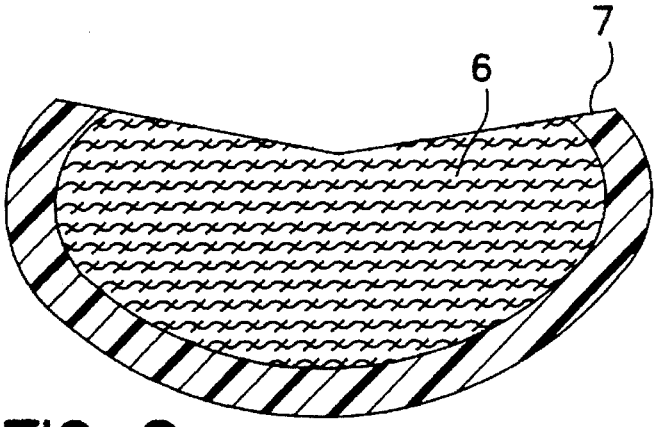
FIG. 2*a* shows a vertical section through a drip catcher according to a second embodiment of the invention, with a brim-shaped saturation indicator and seen from the front.
Figure 2B:
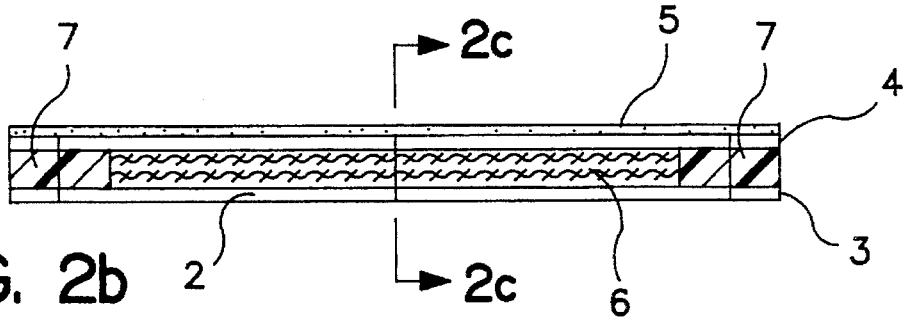
FIG. 2*b* shows the same drip catcher seen from above.
Figure 2C:
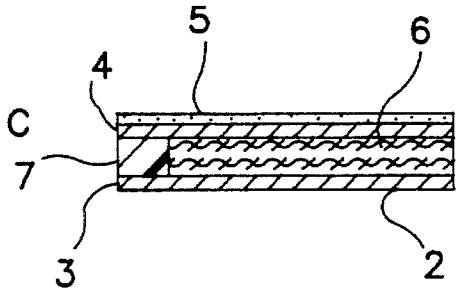
FIG. 2*c* shows a cut along the line 2*c*—2*c* in FIG. 2*b*.
Figure 2D:
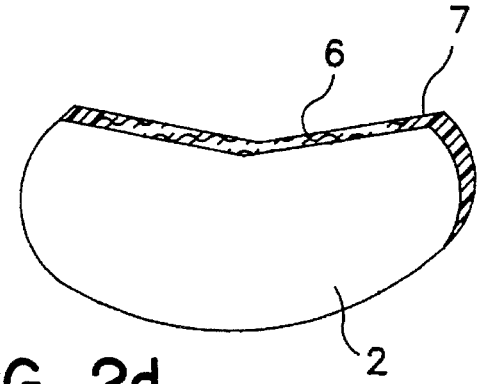
FIG. 2*d* is a perspective view of the same drip catcher.

The drip catcher shown in FIGS. 1*a*–1*d* consists of a small, essentially flat pocket 1 of liquid-tight, non-transparent plastic foil shaped as an ellipse, of which a small part has been cut away. The upper part of the pocket is thus open while the part shaped as an ellipse forms the pocket proper in that the back and front walls, both made from foil material, have been glued or welded along their borders 3 and 4, as will appear from FIGS. 1*b* and 1*c*. Before the front and back walls of the drip catcher are joined, the front wall 2 has been suitably shaped to obtain greater bending capacity without compression of the absorbing material and the entrance opening of the drip catcher.

The pocket 1 is filled with a hydrophilic material 6, which gives the drip catcher great capacity for absorption of water-based liquids. The back wall of the drip catcher is supplied with a thin layer of adhesive 5 for direct application of the drip catcher onto the wall of the container, e.g., a pitcher or similar container, if necessary after removal of a protective strip covering the adhesive.

The drip catcher may further be provided with a saturation indicator which shows when the hydrophilic material is so saturated with liquid that the drip catcher should be replaced.

For colorless liquids, the indicator effect may be obtained with a chemical compound which changes color when it reacts with the colorless liquid. In the case of acids or bases, the indicator may therefore be an acid-base indicator (pH indicator). For colored liquids, such as coffee or tea, the indicator effect is obtained by a direct coloration of the hydrophilic material.

The saturation indicator shown in FIGS. 2*a*–2*d*, where identical parts have the same reference numbers as in FIGS. 1*a*–1*d*, is constituted by a brim 7 of a more compact and less hydrophilic material than the strongly hydrophilic material 6 in the central part of the pocket. The brim 7 forms, together with the borders 3 and 4 of the front and back side foils, a downwardly, practically liquid-tight pocket, most clearly shown in FIGS. 2*b* and 2*c*. Because of the large difference in hydrophilicity between the brim material 7 and the absorbing material 6 in the central part of the pocket 1, water-based liquids are preferentially absorbed by the material 6 in the central part and will only to a minor degree diffuse into the brim material 7. Not until the central part of the strongly-absorbing material 6 is practically saturated with liquid will the liquid seriously begin to penetrate into the brim material 7 which then changes color and thereby indicates that the drip catcher should be replaced.

Figure 3:
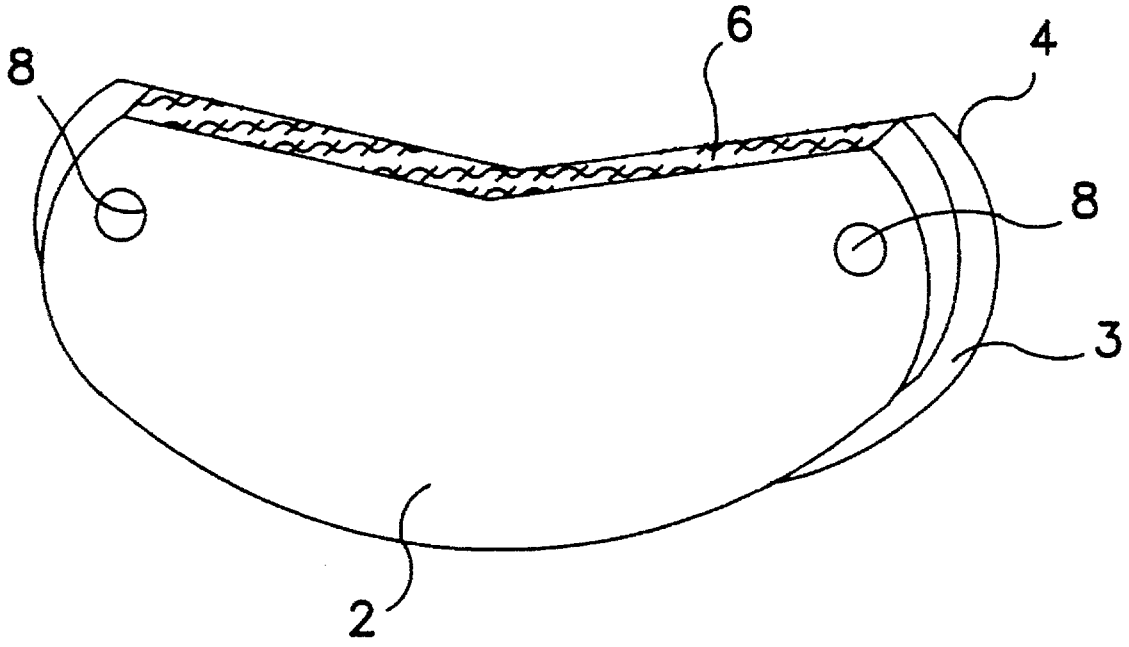
FIG. 3 is a perspective view of a drip catcher according to a third embodiment of the invention and whose front wall has been provided with transparent or uncovered areas which serve as saturation indicators.

As shown in FIG. 3, a saturation indicator may alternatively be made by letting a small part 8 of the front wall of the pocket be transparent or uncovered by the non-transparent foil. The change in color of the strongly-absorbing material 6 in the pocket will then be visible without having at the same time an unaesthetic effect.

We claim:

1. A drip catcher comprising a first wall made from water-proof plastic foil material delimited by an outer contour, a second wall made from water-proof plastic foil material delimited by an outer contour, and a filling of hydrophilic aqueous liquid absorbing material, said first and said second walls being joined at portions of their respective outer contours so as to form an essentially liquid-impermeable envelope with an opening define by the unjoined portions of the respective outer contours of said first and second walls, said envelope containing said filling of hydrophilic material, said first wall comprising an at least partially transparent area, and said drip catcher comprising a filling of indicator material arranged in said envelope adjacent to said at least partially transparent area for developing a visible indication upon reaction with liquid, and said indicator material exhibiting hydrophilicity to a lower degree than said filling or hydrophilic material so that said indicator material wall only absorb liquid once the filling of hydrophilic material has become saturated.

2. A drip catcher according to claim 1 wherein a respective portion of said outer contours is formed essentially as an ellipse.

3. A drip catcher according to claim 1, wherein said first wall comprises transparent and non-transparent areas.

4. A drip catcher according to claim 1, wherein said walls are joined by gluing or welding.

5. A drip catcher according to claim 1 wherein said second wall is provided with adhesive over at least a portion of an outer surface thereof.

6. A drip catcher according to claim 1 wherein said filling of indicator material is comprised in a brim extending along portions of said contours of said walls.

* * * * *